US011174054B2

(12) United States Patent
Brizzi

(10) Patent No.: US 11,174,054 B2
(45) Date of Patent: Nov. 16, 2021

(54) DEVICE FOR SPACING A FLAP BEFORE FILLING FOR PACKAGING CONTAINERS SUCH AS CARDBOARD BOXES AND EQUIPPED FILLING STATIONS

(71) Applicant: BOBST MEX SA, Mex (CH)

(72) Inventor: Nicolas Brizzi, Martigny (CH)

(73) Assignee: BOBST MEX SA, Mex (CH)

( * ) Notice: Subject to any disclaimer, the term of this patent is extended or adjusted under 35 U.S.C. 154(b) by 182 days.

(21) Appl. No.: 16/328,153

(22) PCT Filed: Sep. 21, 2017

(86) PCT No.: PCT/EP2017/025266
§ 371 (c)(1),
(2) Date: Feb. 25, 2019

(87) PCT Pub. No.: WO2018/059741
PCT Pub. Date: Apr. 5, 2018

(65) Prior Publication Data

US 2019/0193886 A1 Jun. 27, 2019

(30) Foreign Application Priority Data

Sep. 28, 2016 (EP) ..... 16020358

(51) Int. Cl.
*B65B 43/48* (2006.01)
*B65B 43/39* (2006.01)
(Continued)

(52) U.S. Cl.
CPC ..... *B65B 43/39* (2013.01); *B65B 25/143* (2013.01); *B65B 25/145* (2013.01); *B65B 43/52* (2013.01);
(Continued)

(58) Field of Classification Search
CPC ..... B65B 43/38; B65B 43/39; B65B 43/00
(Continued)

(56) References Cited

U.S. PATENT DOCUMENTS 2,761,263 A 9/1956 Bruce
3,141,279 A * 7/1964 Arnett ..... B65B 43/39 53/382.3
(Continued)

FOREIGN PATENT DOCUMENTS

CH 659627 A5 2/1987
EP 1437302 A1 7/2004
(Continued)

OTHER PUBLICATIONS

International Search Report of related PCT/EP2017/025266, dated Oct. 26, 2017 (4 pages).

*Primary Examiner* — Gloria R Weeks
(74) *Attorney, Agent, or Firm* — Bookoff McAndrews, PLLC

(57) ABSTRACT

According to the invention, the device comprises at least one flap spreading head (12*a*, 12*b*), the flap spreading head being vertically mobile for insertion thereof into a container (3) to be processed and including first and second flap spreading blades ($\mathbf{121}_1$, $\mathbf{121}_2$) mounted on pivots and an actuator ($\mathbf{122}_1$, $\mathbf{122}_2$). The actuator is adapted to command rotation of the flap spreading blades that on rotating come into contact with flaps (R1*a*, R1*b*) and bring about spreading thereof by folds toward the exterior of the container.

15 Claims, 5 Drawing Sheets

(51) Int. Cl.
*B65B 25/14* (2006.01)
*B65B 43/52* (2006.01)
*B65B 59/00* (2006.01)
*B65B 5/10* (2006.01)

(52) U.S. Cl.
CPC ..... *B65B 59/003* (2019.05); *B65B 59/005* (2013.01); *B65B 5/108* (2013.01)

(58) Field of Classification Search
USPC ..... 53/382.1, 382.2, 387.1, 387.2
See application file for complete search history.

(56) References Cited

U.S. PATENT DOCUMENTS 3,184,898 A * 5/1965 Berney ..... B65B 43/39 53/382.2
3,309,842 A * 3/1967 Arnett ..... B65B 43/39 53/382.3
3,587,207 A * 6/1971 Shuttleworth ..... B65B 43/39 53/381.1
3,662,516 A * 5/1972 Wiseman ..... B65B 43/39 53/76
3,889,442 A * 6/1975 Grahn ..... B65B 43/38 53/492
3,948,151 A * 4/1976 Derderian ..... B31B 70/00 493/128
4,010,597 A * 3/1977 Nelson ..... B65B 7/20 53/376.5
4,124,969 A * 11/1978 Peyton ..... B65B 43/39 414/411
4,191,005 A * 3/1980 Vinoskey ..... B65B 43/39 414/411
4,543,767 A * 10/1985 Wiseman ..... B65B 43/39 53/382.3
4,548,539 A * 10/1985 Nagashino ..... B65B 69/00 414/403
4,562,686 A * 1/1986 Focke ..... B65B 61/00 493/183
4,565,050 A * 1/1986 Norris ..... B65B 7/20 53/376.5
4,638,620 A * 1/1987 Johnson ..... B65B 43/39 53/382.2
4,656,815 A 4/1987 Jaton
5,015,141 A * 5/1991 Ferrence ..... B65G 67/26 198/476.1
5,078,566 A * 1/1992 Ferrence ..... B65G 67/26 198/747
5,175,976 A * 1/1993 Petry ..... B65B 39/14 53/252
5,184,996 A * 2/1993 Rode ..... B31B 50/00 493/102
5,269,742 A * 12/1993 Crouch ..... B65B 43/39 493/177
5,771,661 A * 6/1998 Martin ..... A24B 3/00 414/420
6,070,396 A * 6/2000 Rinaldi ..... B65B 7/20 493/23
6,098,375 A * 8/2000 Button ..... B65B 43/39 53/247
6,385,945 B1 * 5/2002 Hahnel ..... B65B 7/20 53/252
6,742,647 B2 * 6/2004 De Greef ..... B65G 17/323 198/470.1
6,883,296 B2 * 4/2005 Hartness ..... B65B 21/183 53/247
6,955,032 B2 * 10/2005 Smith ..... B65B 43/305 493/125
7,216,468 B2 * 5/2007 Goodman ..... B65B 7/20 493/183
7,331,916 B2 * 2/2008 Fox ..... B31B 50/00 493/162
7,788,884 B2 * 9/2010 Cheich ..... B65B 55/20 53/472
8,109,062 B2 * 2/2012 Chase ..... B65B 7/20 53/76
8,156,719 B2 * 4/2012 Reuteler ..... B65B 57/04 53/484
10,633,126 B2 * 4/2020 Sain ..... B65B 43/39
10,661,931 B2 * 5/2020 Scaglione ..... B65B 21/02
2011/0005174 A1 * 1/2011 Prahm ..... B65B 5/061 53/473
2015/0151860 A1 * 6/2015 Sain ..... B65B 43/39 53/376.4
2019/0193886 A1 * 6/2019 Brizzi ..... B65B 25/143

FOREIGN PATENT DOCUMENTS

FR 3084060 * 1/2020 ..... B65B 43/38
JP S51017894 A 2/1976
JP S54104016 A 8/1979
JP H047403 U 1/1992
JP H07267221 A 10/1995
JP H10077007 A 3/1998
JP 2007176492 A 7/2007
JP 2014162216 A 9/2014

* cited by examiner

DEVICE FOR SPACING A FLAP BEFORE FILLING FOR PACKAGING CONTAINERS SUCH AS CARDBOARD BOXES AND EQUIPPED FILLING STATIONS

CROSS-REFERENCE TO RELATED APPLICATION(S)

This application is a National Stage under 35 U.S.C. § 371 of International Application No. PCT/EP2017/025266, filed on Sep. 21, 2017, which claims priority to European Patent Application No. 16020358.4, filed Sep. 28, 2016, the contents of all of which are incorporated by reference in their entirety.

The present invention is generally concerned with the field of packaging. The invention is more particularly concerned with an automatic device for spreading flap of packaging containers such as cardboard boxes with multiple flaps before filling of these containers with the articles that they are intended to contain. The invention also concerns a filling station equipped with an automatic flap spreading device of this kind.

Folding-gluing machines glue and fold flat folding boxes intended to contain products such as blister packs of drugs or other products, for example packaged by a third party industry. The boxes folded flat can then be stored efficiently in intermediate containers (for example cartons) to be shipped to the industry.

The document CH 659627 describes an example of a station for filling containers with folding boxes at the outlet of a folding-gluing machine. The folded boxes are stacked and then routed by a box conveyor into containers, packing cases or cardboard boxes, or "cartons". Each container can contain a large number of folded boxes, such as several dozen or a hundred boxes.

The carton is formed with four carton bottom flaps and four carton top flaps that are intended to close the carton. The four carton bottom or top flaps include two interior flaps and two exterior flaps.

The filling station is often preceded by a carton forming module operating automatically or semi-automatically. The carton forming module receives the cartons reaching it shingled in folded form, opens them out and closes their bottoms by folding and gluing the flaps, before transferring them to the filling station open at the top to fill them with articles.

In this open state of the carton, the four carton top flaps are in a vertical position, substantially aligned in the same planes as the respective lateral sides of the carton, of which they form extensions. Folding of the flaps toward the exterior of the carton proves necessary for loading high and wide cartons. In effect, the height of the flaps has to be added to the height of the sides. In fact, without this folding operation, the filling station must be much larger.

In the prior art, an operator is generally tasked with effecting these flap spreading operations for each of the cartons arriving in the filling station. This flap spreading task is a tiresome operation for the operator because it is repetitive and to be carried out systematically.

In packaging lines with a very high production rate a plurality of operator stations can prove necessary and this impacts on the required occupied floor surface and costs. Moreover, the reproducibility of this task cannot be guaranteed because it is linked to the personal vigilance of the operator or operators.

SUMMARY OF THE INVENTION

An object of the present invention is to provide a solution to the disadvantages of the prior art explained above by proposing a device capable of automatically spreading the top flaps of packaging containers, or cartons, by folding these flaps toward the exterior of the container, thus guaranteeing correct freeing up of the openings of the containers before filling them with articles.

According to a first aspect, the present invention concerns a device for spreading flaps of a packaging container, the container being empty and including flaps extending vertically in an open top part, the device being adapted to be integrated into a packaging container filling station.

According to the invention, the device comprises at least one flap spreading head, the flap spreading head being mobile vertically for insertion thereof into the container and including first and second flap spreading blades mounted on pivots and an actuator adapted to command rotation of the first and second blades, the first and second blades on rotating coming into contact with first and second flaps and causing spreading thereof by folds towards the exterior of the container.

According to one particular feature of the invention, the device comprises lateral drive belts in parallel alignment with a routing path of the empty and open container to transport the container to a predetermined position in the device, at which position the flap spreading operation is carried out.

According to another particular feature of the invention, the first and second blades are mounted symmetrically in the flap spreader head relative to a vertical axis thereof, in a V-shaped configuration when the first and second blades are folded into a rest position, the tip of the "V" substantially corresponding to a pivot point of the blades.

According to a further particular feature of the invention, the actuator commands rotation in opposite directions about their pivot point of the first and second blades, which come into contact with facing first and second flaps of the container and cause spreading thereof by right-angle folds towards the exterior of the container.

According to a further particular feature of the invention, the device comprises a horizontal upper routing belt for evacuating a container having the facing first and second flaps folded toward the exterior of the container, the driving of the container being brought about by rotation of the horizontal upper routing belt in rubbing contact with top edges of the container.

According to a further particular feature of the invention, the actuator includes first and second cylinders respectively dedicated to the first and second blades.

According to a further particular feature of the invention, the device includes a bridge-shaped frame having first and second vertical pillars with base parts resting on a floor surface and top parts connected by a horizontal crossmember supporting the flap spreading head.

According to a further particular feature of the invention, the device comprises two flap spreading heads. With two heads the folding forces on the sides are balanced. The two heads enable folding in the corners to benefit from the high stiffness of the carton in this area.

According to a further particular feature of the invention, the two flap spreading heads are mounted on a horizontal transverse stringer with an adjustable separation and the stringer is adjustable in height between vertical pillars of the device so as to allow appropriate positioning of the two flap spreading heads for different container dimensions.

According to another aspect, the invention also concerns a packaging container filling station, the containers being empty and including flaps extending vertically in an open top part thereof. According to the invention, the station comprises a flap spreading device as briefly described above.

BRIEF DESCRIPTION OF THE DRAWINGS

Other advantages and features of the present invention will become more clearly apparent on reading the following description of a number of particular embodiments given with reference to the appended drawings, in which.

DETAILED DESCRIPTION OF PREFERRED EMBODIMENTS

Figure 1:
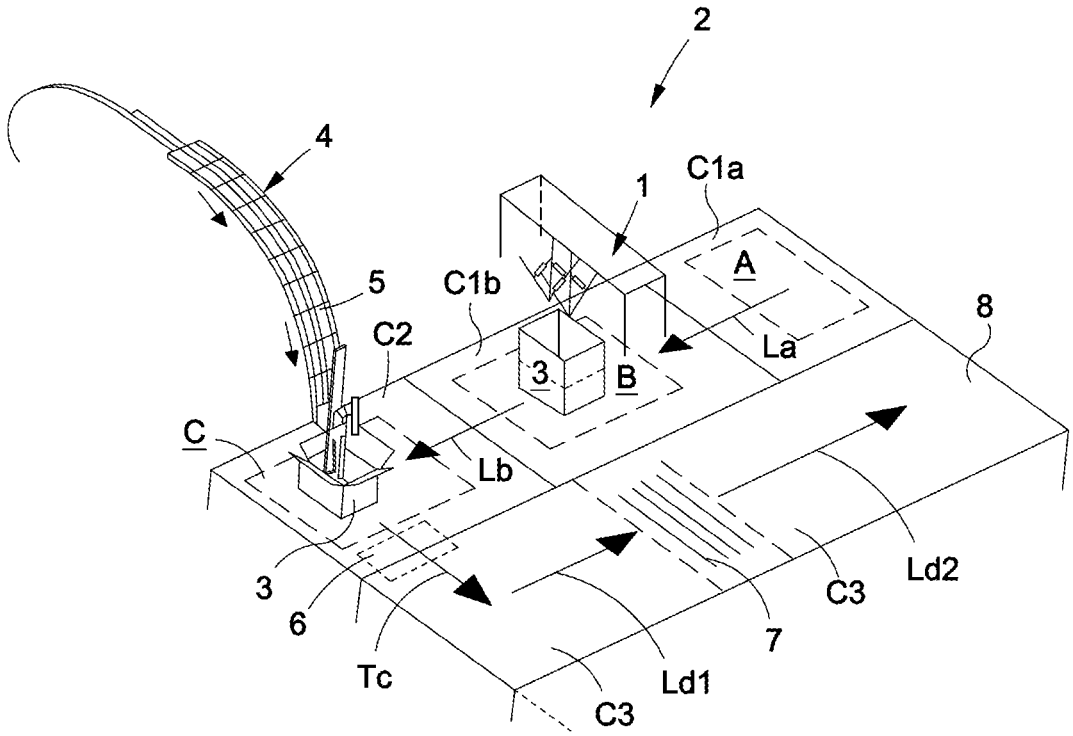
FIG. 1 shows a station for filling containers, such as cartons, in which a flap spreading device according to the invention is installed.

One particular embodiment of the flap folding device 1 according to the invention is described here with reference to FIG. 1 in the context of an application of the device 1 in a station 2 for filling cartons 3 with folding boxes. The station 2 is placed at the outlet of a folding-gluing machine (not shown) that is installed in the vicinity of a filling zone C in FIG. 1. In the filling zone C the cartons 3 are filled with a large number of folding boxes made up and fed to its outlet by the folding-gluing machine. This folding-gluing machine glues and folds flat the folding boxes which can then be lined up, stored, glued and folded with a small overall size in the cartons 3 for transportation.

In the following description, the longitudinal and transverse directions are generally defined with reference to the path of the cartons on a conveyor, along its longitudinal median axis. The upstream and downstream directions are defined with reference to the direction of movement of the cartons along the path.

As FIG. 1 shows, the filling station 2 includes first carton routing conveyors C1*a* and C1*b* including a carton entry zone A, a flap spreading zone B, a flap spreading device 1 according to the invention installed in the flap spreading zone B in which the top flaps R1*a* and R1*b* of the cartons 3 are folded toward the exterior of the cartons 3, a second carton routing conveyor C2 including a filling zone C, a box conveyor-filler 4 installed in the filling zone C and filling the cartons 3 with folding boxes 5 supplied by the folding-gluing machine, a carton transfer device 6 and a third carton routing conveyor C3.

The cartons 3 supplied by the carton forming module (not shown), open at the top and with the flaps R1*a* and R1*b* in a vertical position, are received in the carton entry zone A. The cartons 3, in the state in which they are received in the zone A, are routed by the carton routing conveyor C1*a* along a substantially rectilinear routing path La to a flap spreading zone B to be processed by the flap spreading device 1. When the operation of folding the flaps R1*a* and R1*b* toward the exterior of the carton have been effected by the device 1, the cartons 3 with the flaps R1*a* and R1*b* folded outward are transferred by the carton routing conveyor C1*b* along a substantially rectilinear routing path Lb to the second carton routing conveyor C2 which conveys the cartons 3 to the filling zone C.

In the filling zone C the box conveyor-filler 4 is configured to grasp the folding boxes 5, stacked at the outlet of the folding-gluing machine, for example, and to transfer them at a very high rate and in an ordered manner into a carton 3.

When the carton 3 has been filled with the folding boxes 5 it is transferred by the carton transfer device 6 along a substantially rectilinear routing path Tc perpendicular to the paths La and Lb to the third carton routing conveyor C3.

As shown in FIG. 1, in this embodiment of the filling station 2 the third carton routing conveyor C3 is equipped with a vibrator device 7. The vibrator device 7 momentarily interrupts the transportation of the filled cartons 3 by the conveyor C3 for an operation of vibrating the cartons allowing ordered rearrangement of the folding boxes 5 contained in the cartons 3.

On the third carton routing conveyor C3 the cartons 3 released by the carton transfer device 6 are routed to the vibrator device 7 along a routing path Ld1 parallel to the paths La and Lb but in the opposite direction. After the vibration operation effected in the vibrator device 7, routing by the conveyor C3 resumes, along a routing path Ld2 extending the path Ld1, in order to evacuate the cartons 3 loaded with folding boxes 5 toward an outlet 8 of the filling station 2.

The flap spreading device 1 and the carton routing conveyors C1*a* and C1*b* are now described in detail with reference also to FIGS. 2, 2*a*, 3 to 5 and 6*a* to 6*c*.

Figure 2:
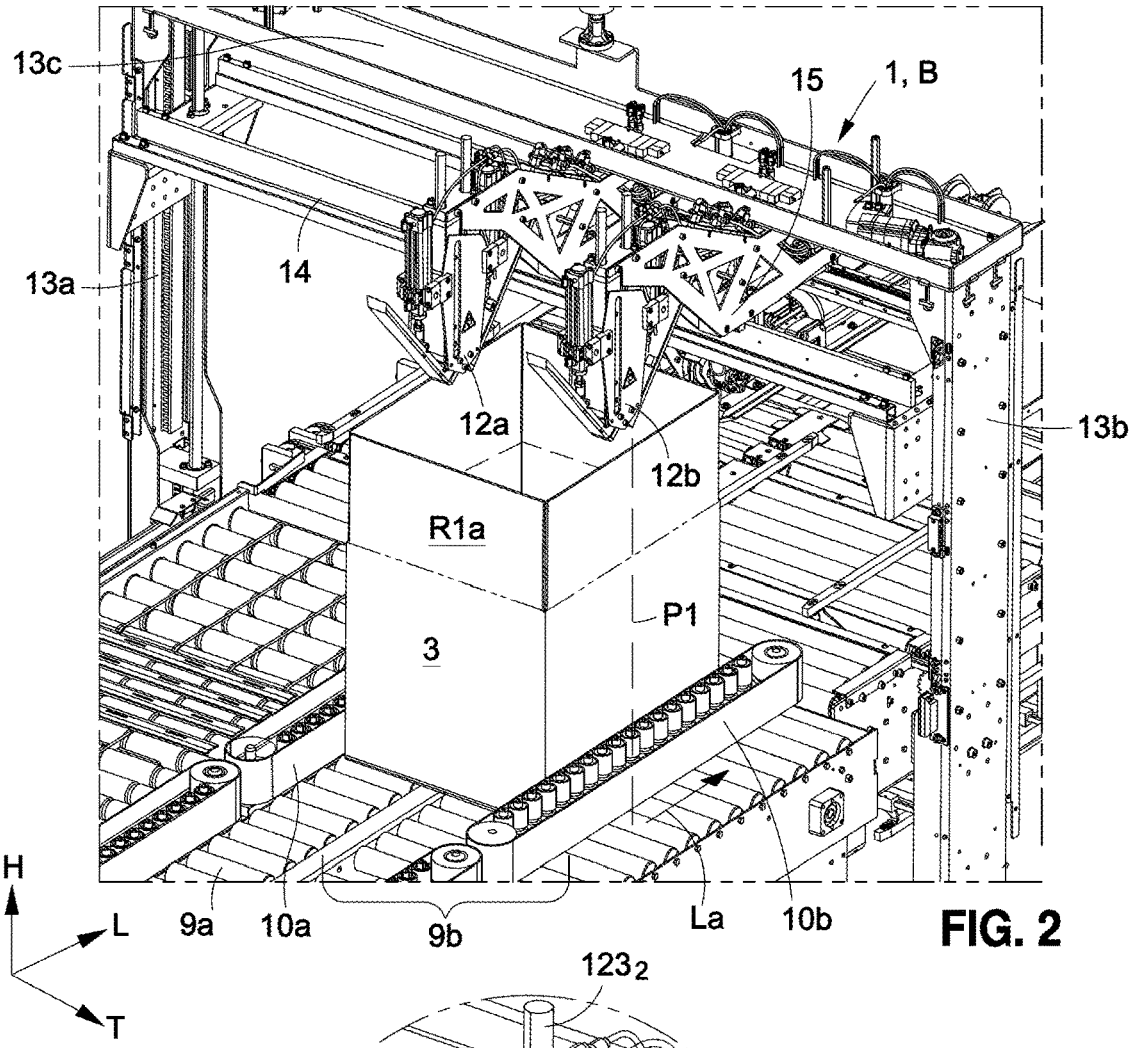
FIG. 2 is a partial perspective view of a flap spreading device according to the invention in a state corresponding to the arrival of a carton to be processed.

As FIG. 2 shows, the carton routing conveyor C1*a* routes the empty cartons 3 with the flaps R1*a* and R1*b* of the carton 3 in the vertical position toward the flap spreading zone B where the flap spreading device 1 is installed.

The conveyor C1*a* includes two series of idler rollers 9*a* and 9*b*. The principal direction of the rollers 9*a* and 9*b* extends in the transverse direction T. The rollers 9*a* and 9*b* are parallel idler rollers in a horizontal plane along the routing path La. The carton routing conveyor C1*a* further includes a lateral driving device configured to drive the cartons 3 in the longitudinal direction L by gripping their opposite side walls at the bottom. To this end the lateral driving device includes for example at least two facing lateral drive belts 10*a* and 10*b* symmetrically arranged on the series of idler rollers 9*a* and 9*b* in parallel alignment with the routing path La. In operation, the cartons 3 are routed along the series of rollers 9*a* and 9*b*, driven and guided laterally by the belts 10*a* and 10*b*. The carton routing conveyor C1*a* enables transportation of the empty and open cartons 3 without deforming them to a predetermined position P1 at the center of the flap spreading zone B in the flap spreading device 1.

In this embodiment the arrival of the carton 3 at this position P1 is detected by an optical position detection cell (not visible). This detection of the arrival of the carton 3 at the position P1 commands the stopping of the lateral drive belts 10*a* and 10*b* and immobilizes the carton 3 under two flap spreading heads 12*a* and 12*b* of the flap spreading device 1.

As is apparent in FIG. 2, the flap spreading device 1 includes a bridge-shaped frame with two vertical pillars 13*a* and 13*b* that have parts forming bases that rest on a floor surface on either side of the carton routing conveyors C1*a*, C1*b* and C3 of the filling station 2 and a top horizontal crossmember 13*c* connecting the top ends of the pillars 13*a* and 13*b*.

The two flap spreading heads 12*a* and 12*b* are fixed and carried by an adjustable horizontal transverse stringer 14 adapted to be adjusted in height H between the pillars 13*a* and 13*b*. The adjustment of the height of the transverse stringer 14 allows appropriate vertical positioning of the heads 12*a* and 12*b* for different carton heights. The device 1 also allows adjustment of the distance between at least one of the two heads 12*a* and 12*b*, for example the head 12*b*, along the transverse stringer 14 so as to be able to adjust the device 1 for different carton widths.

Figure 2A:
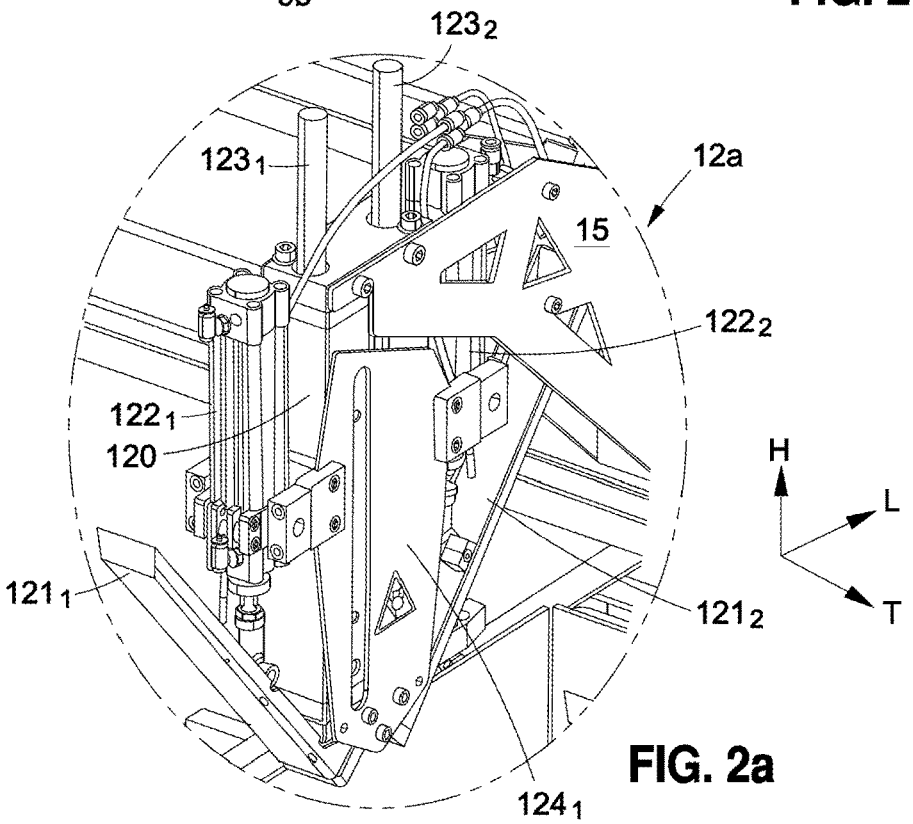
FIG. 2*a* is a partial perspective view of a flap spreading head of the device from FIG. 2.

The flap spreading head 12*a* is shown in detail in FIG. 2*a*, given that the two heads 12*a* and 12*b* have analogous architectures and configurations. The heads 12*a*, 12*b* are also shown in three different operating states in FIGS. 6*a* to 6*c*.

Figures 6A, 6B, 6C:
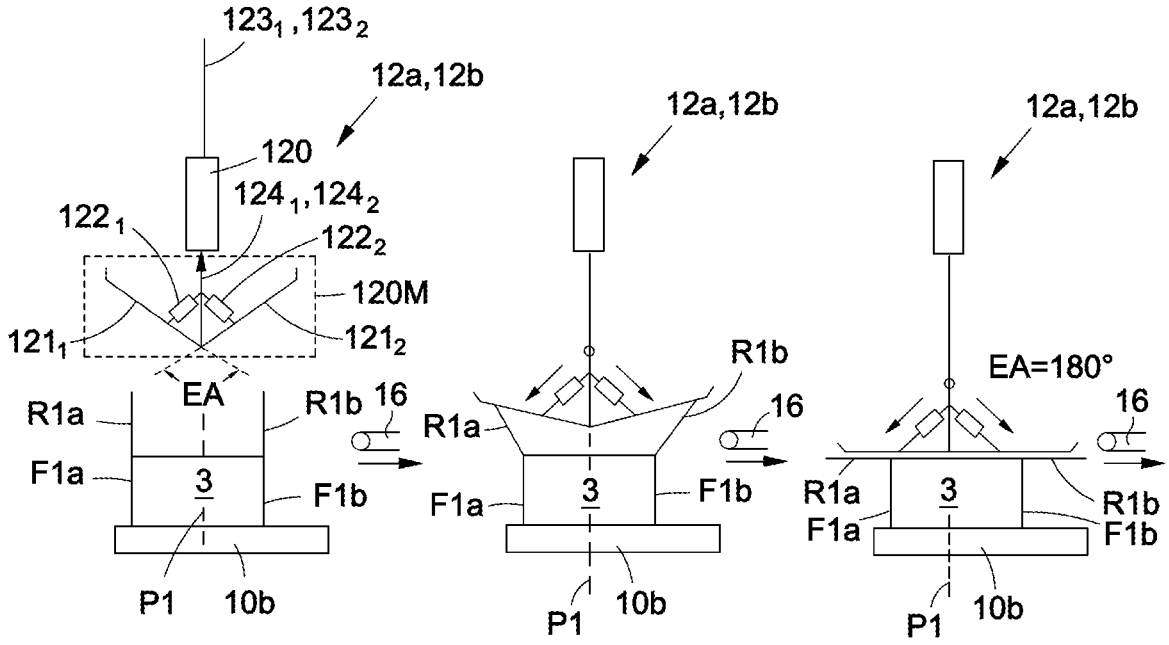
FIGS. 6*a* to 6*c* are side views showing sequentially the opening of blades of the flap spreading heads and folding of two flaps at right angles towards the exterior of the carton.

In FIGS. 2 and 2*a*, the heads 12*a* and 12*b* are represented folded in a rest position, as shown in FIG. 6*a*, in which the heads have no contact with the carton 3. With more particular reference to FIGS. 2*a* and 6*a*, each of the flap spreading heads 12*a*, 12*b* essentially includes a body part 120, a structure 120M (FIG. 6*a*) that is mobile in height H relative to the body part 120, and support and guide rods $\mathbf{123}_1$ and $\mathbf{123}_2$ mechanically coupled to the mobile structure 120M and sliding in corresponding bores (not visible) in the body part 120.

The body part 120 of the flap spreading head 12*a*, 12*b* is mechanically fixed to the adjustable horizontal transverse stringer 14. A perforated sheet metal structure 15 is used for this mechanical fixing to the stringer 14 and allows the heads 12*a*, 12*b* to be advanced above the carton 3 when stationary relative to the horizontal edge of the stringer 14. This advancing of the heads 12*a*, 12*b* enables positioning thereof in a vertical transverse plane forming a central plane of lengthwise symmetry of the carton 3.

The mobile structure 120M essentially comprises first and second flap spreading blades $\mathbf{121}_1$ and $\mathbf{121}_2$, first and second cylinders $\mathbf{122}_1$ and $\mathbf{122}_2$ respectively associated with the first and second blades $\mathbf{121}_1$ and $\mathbf{121}_2$, and sheet metal assembly flanges $\mathbf{124}_1$ and $\mathbf{124}_2$ for the assembly of the blades and cylinders of the mobile structure 120M to the support and guide rods $\mathbf{123}_1$ and $\mathbf{123}_2$. Although only the flange $\mathbf{124}_1$ (FIG. 2*a*) is visible in the figures, a symmetrical flange $\mathbf{124}_2$ facing the flange $\mathbf{124}_1$ is present on the opposite face of the head.

As shown in FIGS. 2, 2*a* and 6*a*, in the folded rest position of the heads 12*a*, 12*b* the blades $\mathbf{121}_1$ and $\mathbf{121}_2$ have a V configuration. In this position, the angle EA (FIG. 6*a*) of the V formed by the blades has its smallest value. The bottom ends of the blades, in immediate proximity, are mounted on pivots held between the flanges $\mathbf{124}_1$ and $\mathbf{124}_2$ and are therefore mobile in rotation about their respective pivot points.

Figure 3:
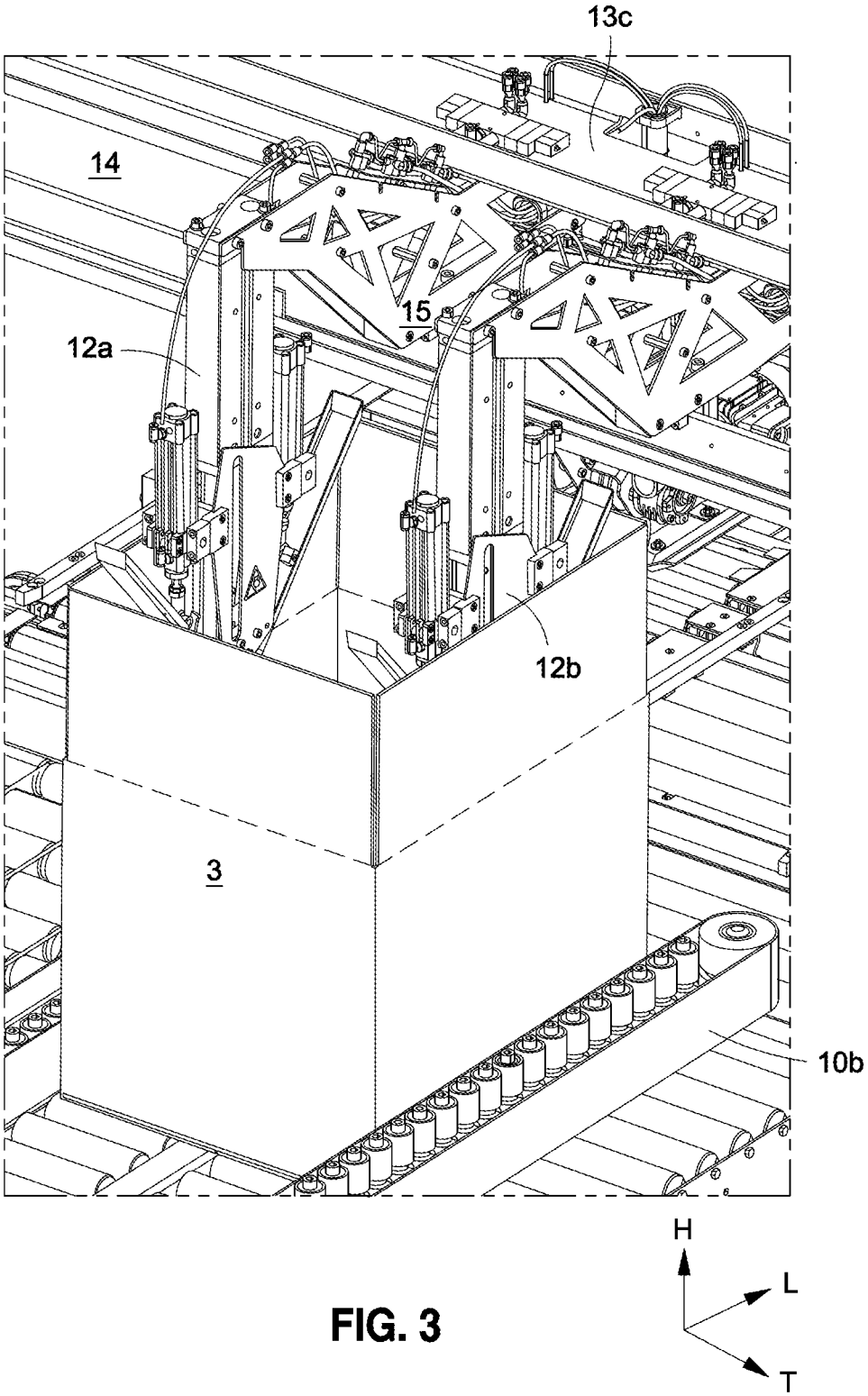
FIG. 3 is a partial perspective view of the device from FIG. 2 in a state corresponding to the insertion of flap spreading heads into the opening of a carton to be processed.

In FIGS. 3 and 6*b*, the heads 12*a* and 12*b* are shown in a position of insertion into the top opening of the carton 3. In FIG. 3, the heads are moved inside the carton 3 by sliding of the mobile structure 120M along the rods $\mathbf{123}_1$, $\mathbf{123}_2$, the sliding of the mobile structure 120M being controlled by a pneumatic cylinder (not visible) integrated between the two guide rods of the body part 120. In this position, a command to spread or open the blades $\mathbf{121}_1$, $\mathbf{121}_2$ by rotation about their respective pivot points has the effect of spreading the flaps R1*a* and R1*b* of the carton 3 in contact with the blades $\mathbf{121}_1$, $\mathbf{121}_2$, by folding them toward the exterior of the carton 3. The blades $\mathbf{121}_1$, $\mathbf{121}_2$ are spread by actuating the cylinders $\mathbf{122}_1$, $\mathbf{122}_2$.

Thus in FIG. 6*b* the cylinders $\mathbf{122}_1$ and $\mathbf{122}_2$ are actuated. The blades $\mathbf{121}_1$ and $\mathbf{121}_2$, moved by the cylinders $\mathbf{122}_1$ and $\mathbf{122}_2$, respectively come to bear on the upper edges of the flaps R1*a* and R1*b* of the carton 3 which are then progressively spread by folding them toward the outside of the carton 3. In this state, the actuation of the cylinders $\mathbf{122}_1$ and $\mathbf{122}_2$ continues until the blades $\mathbf{121}_1$ and $\mathbf{121}_2$ are completely open, i.e. aligned in the same horizontal plane with an angle EA of 180°.

Figure 4:
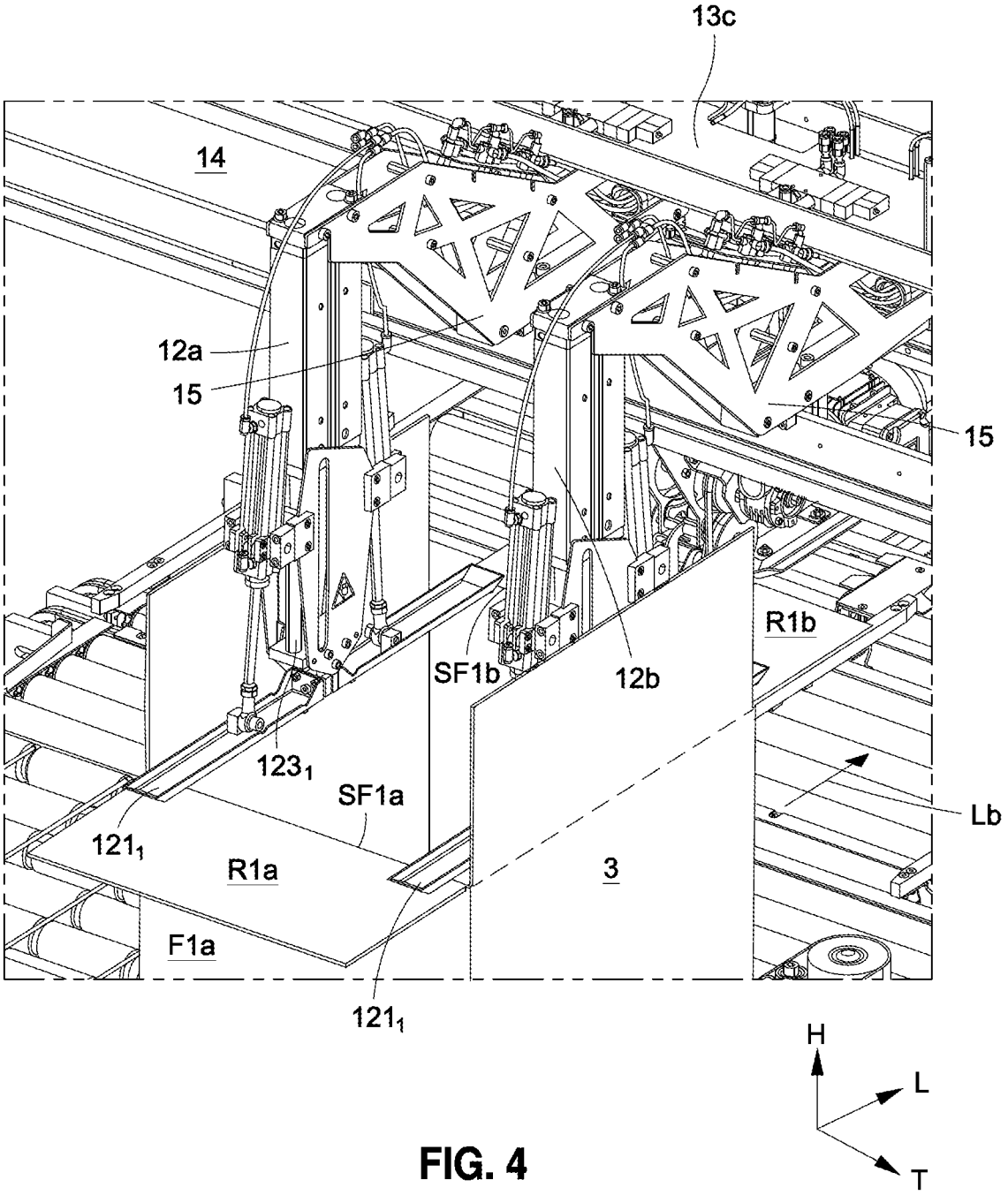
FIG. 4 is a partial perspective view of the device from FIG. 2 in a state corresponding to opening of blades of the flap spreading heads and folding of two flaps at right angles towards the exterior of the carton.

The fully open state, EA=180°, of the blades $\mathbf{121}_1$ and $\mathbf{121}_2$ is shown in FIGS. 4 and 6*c*. In this state, the flaps R1*a* and R1*b* are folded toward the outside, at right angles relative to the corresponding sides F1*a* and F1*b* of the carton 3, respectively.

At this stage the operation of spreading of the flaps by the device 1 by folding the latter at 90° toward the exterior of the carton 3 is finished.

The subsequent operations effected by the device 1 consist essentially in evacuating the carton 3 toward the conveyors C1*b* and C2 in the direction of the filling zone C, the flaps R1*a* and R1*b* remaining folded at right angles toward the exterior of the carton 3 during at least a part of the movement so as to "fix" their position optimally.

Figure 5:
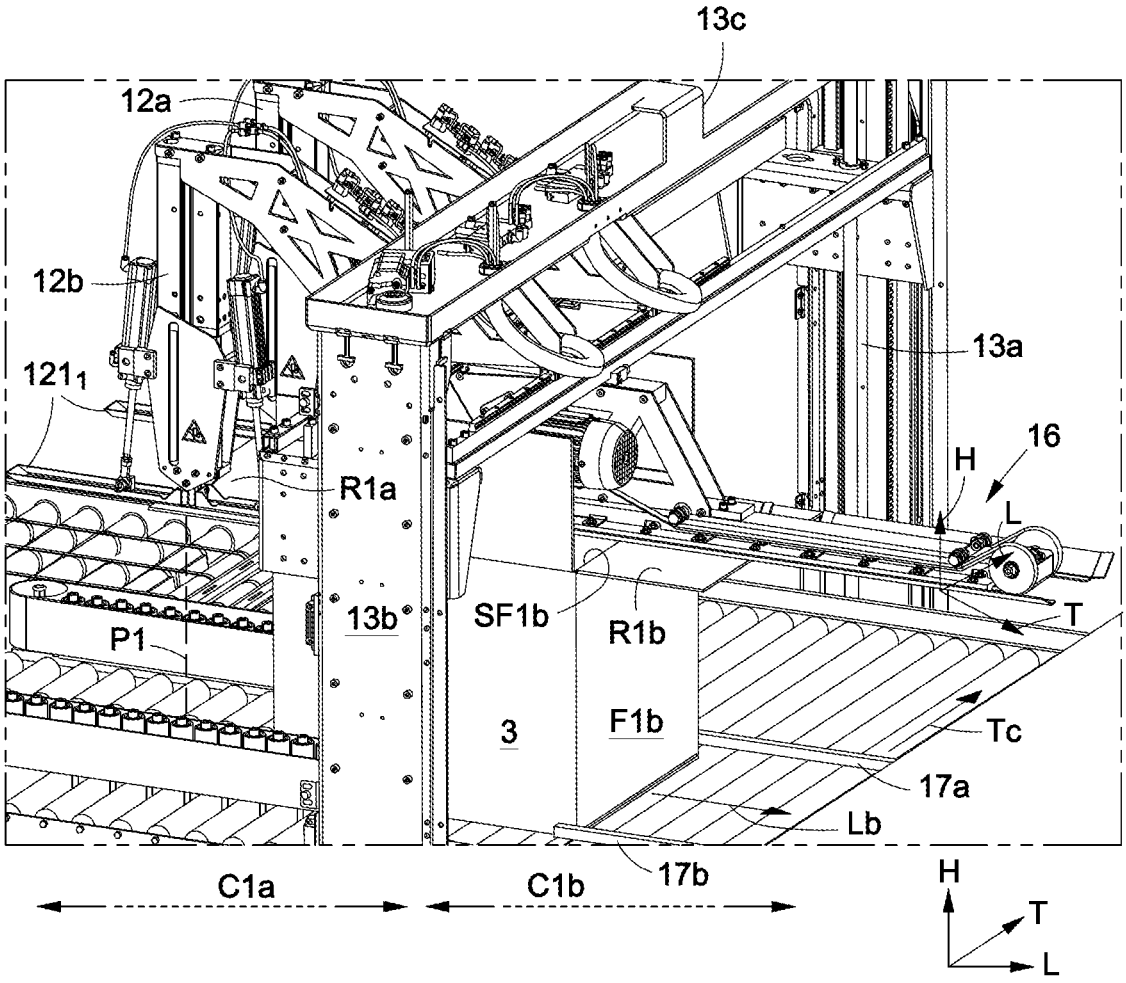
FIG. 5 is a partial perspective view of the device from FIG. 2 in a state corresponding to evacuation of a processed carton having flaps folded.

The operations of evacuation of the carton 3 referred to above and effected by the device 1 are described in detail now with more particular reference to FIG. 5. In FIG. 5, the movement of the carton 3 resumes and it moves along the routing path Lb. As is apparent in FIG. 5, the blades 121 remain open to 180° during the movement shown in FIG. 5.

This resumption of movement of the carton 3 in the device 1 is commanded immediately following the state shown in FIGS. 4 and 6*c* in which the blades $\mathbf{121}_1$ and $\mathbf{121}_2$ have opened to 180°. Resumed rotation of the belts 10*a* and 10*b* in the device 1 is then commanded together with rotation of a horizontal upper routing belt 16 shown in FIG. 5.

The upper routing belt 16 is disposed at a height H relative to the rollers of the conveyors C1*a* and C1*b* so that a horizontal lower face thereof can come into rubbing contact with the top edges SF1*a*, SF1*b* (FIGS. 4 and 5) of the sides F1*a*, F1*b* of the carton 3 without excessive bearing pressure.

As the carton 3 advances along the routing path Lb, triggered by the restarting of the belts 10*a* and 10*b* immediately following the state shown in FIG. 4, the flap R1*b* is progressively disengaged from the blade 121 to slide under the horizontal lower face of the upper routing belt 16. The top edge SF1*b* of the side F1*b* has then come into interengagement with the lower face of the belt 16. Starting from this interengagement of the top edge SF1*b* with the belt 16, the latter begins its effective participation in the driving of the carton 3 along the routing path Lb.

In the state shown in FIG. 5, the carton 3 is routed along the path Lb by the conjoint action of the belts 10*a* and 10*b* on its base and that of the belt 16 on the top edge SF1*b*. The base of the carton 3 is also engaged between guide bars 17*a* and 17*b* that are raised relative to the idler rollers of the conveyor C1*b*. These bars 17*a* and 17*b* guide the carton 3 along the routing path Lb as far as the conveyor C2 of the filling zone C.

Thereafter, as the carton 3 advances along the routing path Lb the flap R1*a* is disengaged completely from the blades 121 and the base of the carton 3 is also disengaged completely from the belts 10*a* and 10*b*. The carton 3 is then pulled forward by the rotation of the belt 16 in rubbing contact with the top edges SF1*a* and SF1*b*. The flap spreading heads 12*a* and 12*b* are then folded and returned to the rest position shown in FIGS. 2, 2*a* and 6*a*.

The other two top flaps of the carton 3 which are still vertical on leaving the device 1 can also be folded toward the exterior of the carton 3 by means of two guide plates (not shown) disposed longitudinally on respective opposite sides of the heads 12*a* and 12*b*.

The various possible embodiments of the invention are not limited to the modifications and variants indicated here by way of example, and other modifications and variants falling within the scope of the appended claims can be envisaged.

In some embodiments of the invention equipping the flap spreading device with only one head, possibly provided with wider blades, could be envisaged, for example for cartons of smaller size.

The invention claimed is:

1. A device for spreading first and second flaps extending vertically in an open top part of a packaging container and foldable along a first folding axis and a second folding axis, respectively, of the packaging container, the device comprising:

a first flap spreading head and a second flap spreading head, the first and second flap spreading heads being mobile vertically for insertion into the container, and the first flap spreading head being mobile horizontally relative to the second flap spreading head along a moving axis parallel to the first folding axis and the second folding axis, wherein each of the first and second flap spreading heads includes respective first and second flap spreading blades mounted on respective pivots of the first and second flap spreading heads and extending along an axis perpendicular to the moving axis, and wherein each of the first and second flap spreading heads includes a respective actuator adapted to rotate the respective first and second blades to respectively contact the first and second flaps to spread the first and second flaps towards an exterior surface of the container by folding the first and second flaps along the first folding axis and the second folding axis, respectively.

2. The device of claim 1, in which the respective first and second flap spreading blades are mounted symmetrically in each of the first and second flap spreading heads relative to a vertical axis thereof, in a "V-shaped" configuration when the respective first and second flap spreading blades are folded into a retracted position, a tip of the "V" substantially corresponding to a pivot point of the respective first and second flap spreading blades.

3. The device of claim 2, in which the respective first and second blades rotate in opposite directions about the pivot point of the respective first and second blades.

4. The device of claim 2, wherein the respective first and second flap spreading blades are substantially horizontal in an extended position of the respective actuators.

5. The device of claim 1, in which the respective actuators include first and second cylinders respectively dedicated to the first and second flap spreading blades.

6. The device of claim 1, further comprising a horizontal transverse stringer, in which the first and second flap spreading heads are mobile horizontally along the moving axis on the horizontal transverse stringer.

7. The device of claim 6, in which the horizontal transverse stringer is mobile vertically.

8. A packaging container filling station comprising the device of claim 1.

9. The packaging container filling station of claim 8, further comprising a lateral drive belt in parallel alignment with a routing path of the packaging container to transport the packaging container to a predetermined position in the packaging container filling station to spread the first and second flaps.

10. The packaging container filling station of claim 9, further comprising at least one horizontal upper routing belt to transport the packaging container from the predetermined position by contacting top edges of the packaging container.

11. The packaging container filling station of claim 8, further comprising a bridge-shaped frame having first and second vertical pillars with bases to rest on a floor surface and top parts connected by a horizontal crossmember supporting the first and second flap spreading heads.

12. An apparatus for moving, along a folding axis, a top closing flap of a container from a first position extending away from an interior of the container in a substantially vertical direction to a second position extending away from the interior of the container in a substantially horizontal direction, the apparatus comprising:

a first flap spreading head movable in a vertical direction, and including:

a first spreading blade extending from the first flap spreading head along a first spreading blade axis perpendicular to a moving axis parallel to the folding axis, and pivotable on the first flap spreading head on a first pivot axis parallel to the moving axis, and a first actuator to pivot the first spreading blade from a raised position to a lowered position; and a second flap spreading head movable in the vertical direction and movable relative to the first flap spreading head along the moving axis parallel to the folding axis, and including:

a second spreading blade extending from the second flap spreading head along a second spreading blade axis perpendicular to the moving axis, and pivotable on the first flap spreading head on a second pivot axis parallel to the moving axis, and a second actuator to pivot the second spreading blade from a raised position to a lowered position.

13. A method for operating the apparatus of claim 12, the method comprising:

lowering the first flap spreading head and the second flap spreading head toward the container;

pivoting the first spreading blade and the second spreading blade from the raised position to the lowered position, respectively, to move, along the folding axis, the top closing flap of the container from the first position to the second position;

operating the first actuator and the second actuator to pivot the first spreading blade and the second spreading blade from the lowered position to the raised position, respectively; and raising the first flap spreading head and the second flap spreading head.

14. The method of claim 13, further comprising:

moving the second flap spreading head relative to the first flap spreading head along the moving axis to adjust the apparatus for a size of the container.

15. A device for spreading first and second flaps extending vertically in an open top part of a packaging container and foldable along a first folding axis and a second folding axis, respectively, of the packaging container, the device comprising:

at least one flap spreading head being mobile vertically for movement towards the container and being mobile horizontally along a moving axis parallel to the first folding axis and the second folding axis, wherein the at least one flap spreading head includes first and second flap spreading blades mounted on at least one pivot and extending along an axis perpendicular to the moving axis, and wherein the at least one flap spreading head includes an actuator adapted to rotate the first and second blades to respectively contact the first and second flaps to spread the first and second flaps towards an exterior surface of the container by folding the first and second flaps along the first folding axis and the second folding axis, respectively.

* * * * *